US005664287A

United States Patent [19]

Sendelbach

[11] Patent Number: 5,664,287

[45] Date of Patent: Sep. 9, 1997

[54] HANDLE ATTACHMENT FOR ROUND DOOR KNOBS

[76] Inventor: Karl Sendelbach, 2412 St Helena Dr. #1, Hayward, Calif. 94542

[21] Appl. No.: 621,717

[22] Filed: Mar. 28, 1996

[51] Int. Cl.[6] ..... E05B 1/00; E05B 7/00

[52] U.S. Cl. ..... 16/114 R; 16/121; 292/347

[58] Field of Search ..... 16/114 R, 121, 16/115; 292/336.3, 347, 348, DIG. 2

[56] References Cited

U.S. PATENT DOCUMENTS

| | | | |
|---|---|---|---|
| 2,756,088 | 7/1956 | Sutter | 16/114 R |
| 4,018,465 | 4/1977 | Ramler | 292/347 |
| 4,397,489 | 8/1983 | Lind | 292/347 |
| 4,504,087 | 3/1985 | Pennington | 16/114 R |
| 4,783,883 | 11/1988 | Szalay | 16/114 R |
| 4,913,479 | 4/1990 | Allison | 292/DIG. 2 |
| 5,501,494 | 3/1996 | Willetts | 292/DIG. 2 |

*Primary Examiner*—Chuck Y. Mah

[57] ABSTRACT

The device of the present invention can be attached to a round door knob to make the door knob easy to turn by pushing a levering handle. The handle and clamp are in two pieces that are fastened together to form a single door knob clamp and handle. The two pieces are adjustable relative to each other so the clamp can be opened and closed allowing attachment to a variety of different sized and different shaped door knobs. Easy to install and easy to remove, the invention is designed to remain on the door knob once it has been installed, but it can be removed if desired or necessary. A child cord is affixed through an aperture in the free end of the handle making it easy for a child to open a door.

4 Claims, 2 Drawing Sheets

HANDLE ATTACHMENT FOR ROUND DOOR KNOBS

BACKGROUND OF THE INVENTION

1. Field of the Invention

This invention relates to devices that can be attached to a round door knob to make the door knob easy to turn. The present invention has a levering arm to assist in the turning of the knob. The structure of the invention is two-piece allowing it to be attached to a variety of different sized and different shaped door knobs. The invention is easy to install and easy to remove though it is designed to remain on the door knob once it has been installed.

2. Description of the Prior Art

Although some devices are seen in past art patents for attachment to a door knob for assistance in opening a door, most devices are limited in use by being formed in one piece. An example of this is seen in U.S. Pat. No. 5,288, 116, filed Apr. 15, 1993, Ser. No. 47,866. The device of the invention cups the door handle and is limited to particular types of door knobs. This seems common in devices offered for the purpose of assisting in the opening of a door with a round door knob.

SUMMARY OF THE INVENTION

To overcome the limitations seen in prior single-piece devices, in practicing my invention, I provide a two-piece attachment for round door knobs that can be opened and adjusted to a variety of door knob sizes and shapes. My handle attachment has also a puff cord in the end of the handle that can be used by a child to open a door.

Therefore, a principal object of the present invention is to provide a handle attachment for round door knobs in a two-piece device that can be opened to fit a variety of sizes and shapes of door knob.

Another object of the invention is to provide a door knob handle for round door knobs that is easy to install and easy to remove if necessary.

A further object of the present invention is to provide a door opening device having a handle and the device can be fitted to a door knob with the handle in different positions according to the requirements of the person using it.

A stiff further object of my invention is to provide a door knob opening device having a handle with an aperture in the end of the handle for a cord that a child can pull down to open a door. The cord can be rolled up to prevent any unwanted door openings.

Other objects and the many advantages of the present invention will become clear from reading the following specifications and comparing numbered parts described with the same numbered parts illustrated in the drawings.

DESCRIPTION OF THE PREFERRED EMBODIMENTS

Figure 1:
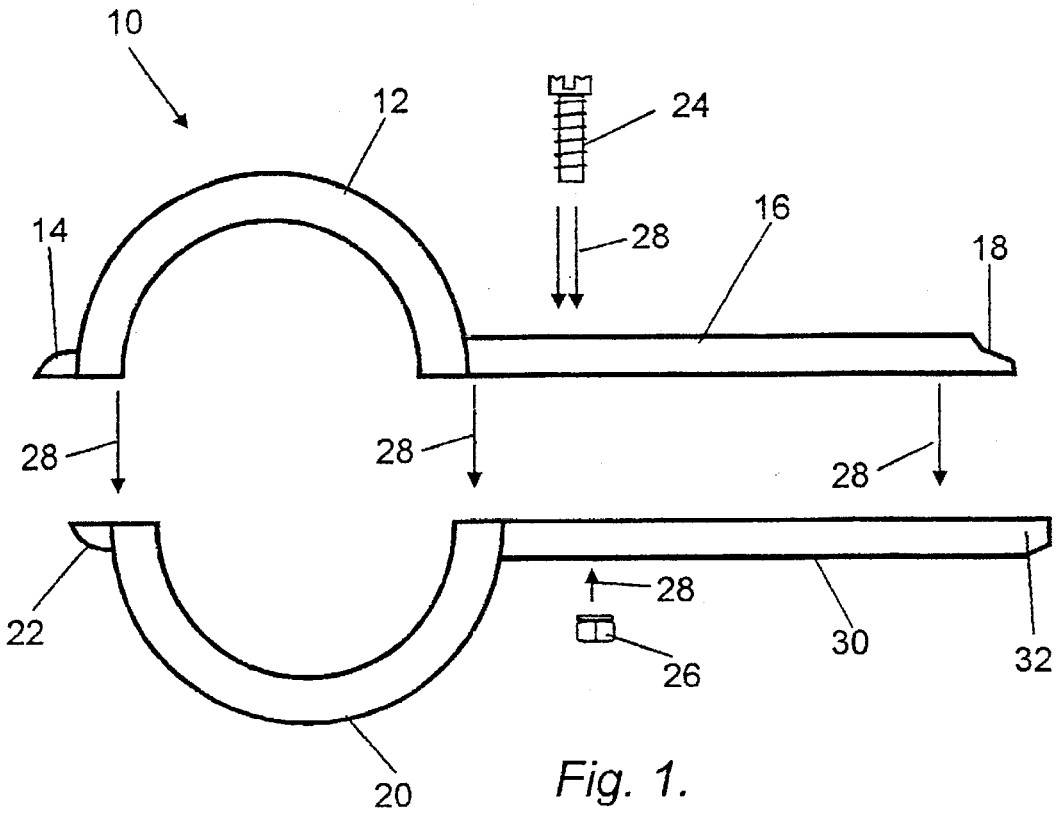
FIG. 1 showing a handle attachment for round door knobs according to the invention. The structure of the invention is two-piece. The drawing shows the two pieces separated and ready to be attached.
Figure 2:
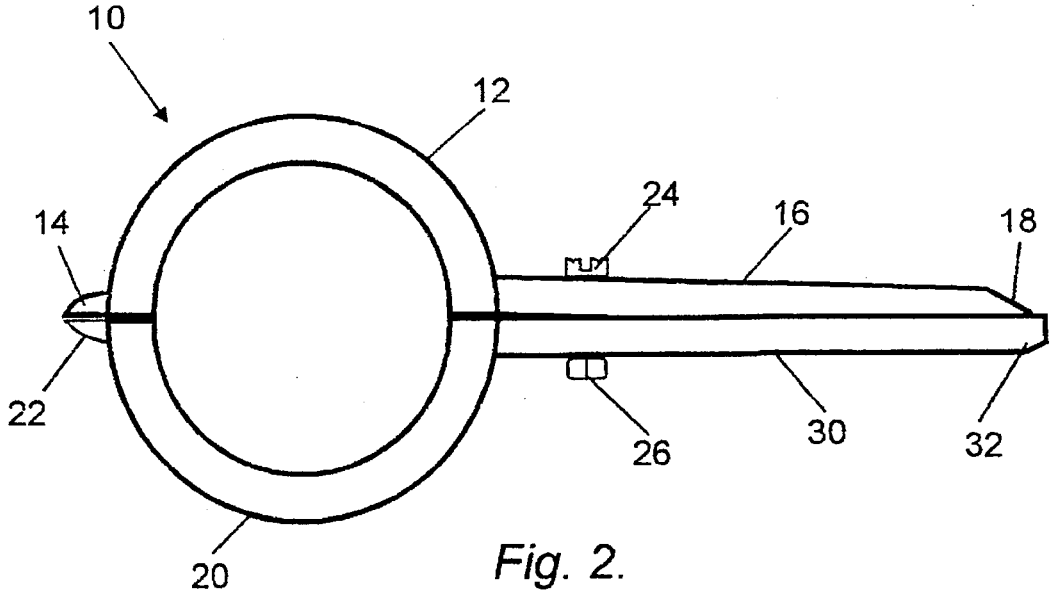
FIG. 2 shows the invention assembled as it is used for attachment to a door knob.

Referring now to the drawings where the invention referenced as 10 is illustrated in the various figures. FIG. 1 shows invention 10 with the two parts of the structure separated, ready for fastening them together. The section illustrated uppermost includes first knob half clamp 12, first clamp head protector 14, and first handle half 16. First handle half 16 is a solid structure. A handle lock end 18 is a small ridge at the end of handle 16. Bolt 24 is shown above handle 16 and arrows 28 indicate where bolt 24 is installed. A second knob clamp half 20 is shown in the illustration below knob clamp half 12 and the other part of the handle 30 has a handle lock catch 32 that accepts the narrowed end handle lock 18. In the assembled view at FIG. 2, the two halves of invention 10 are fastened together to form the invention ready for use. The upper and lower structure 12, 16 top and 20, 30 bottom come together at upper front nose clamp support 14 and lower front nose clamp support 22 at the front. Half handles 16 and 30 hold together at the back by upper handle lock 18 snapped into lower handle lock catch 32 with the entire structure retained by bolt 24 and washer cap nut 26.

Figure 3:
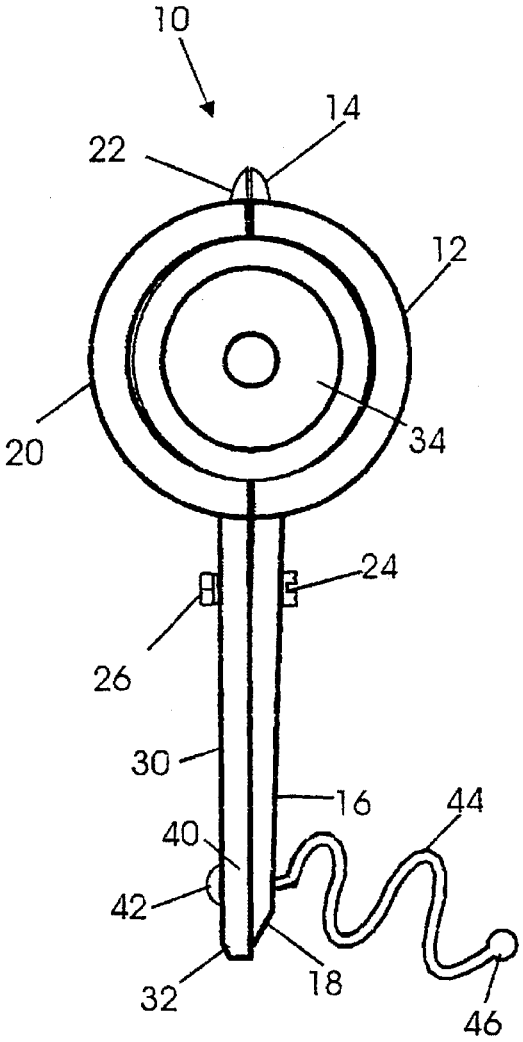
FIG. 3 shows the device of this invention in a frontal view attached to a round door knob with a pull cord in the end of the handle so a child can operate the device.
Figure 4:
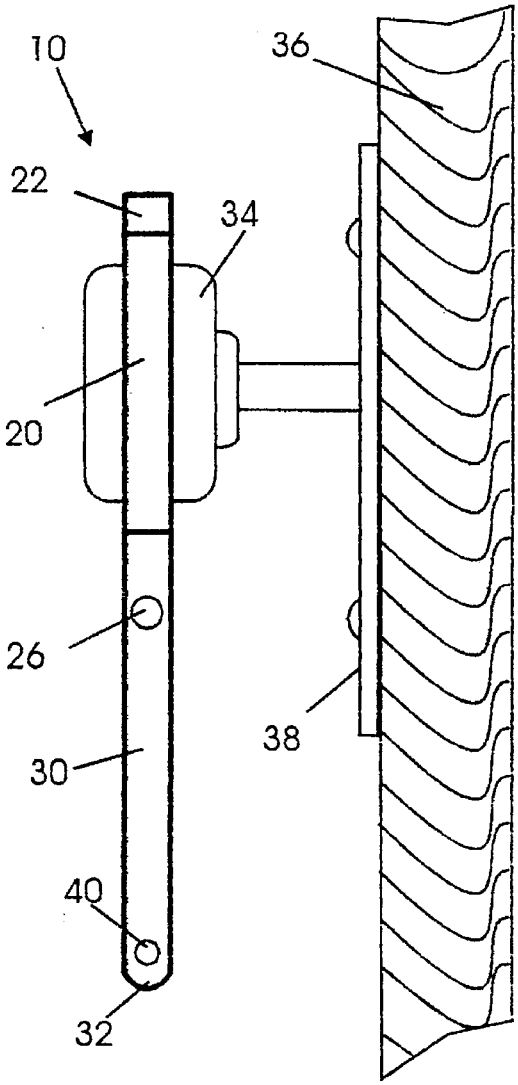
FIG. 4 shows the invention attached to a round door knob in a side view.
Figure 5:
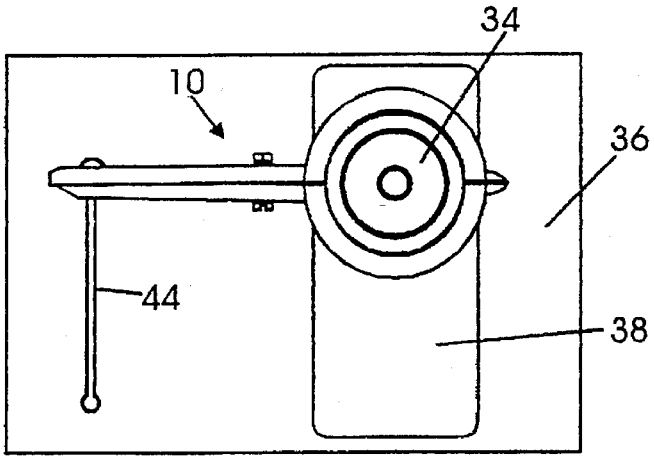
FIG. 5 shows device attached to a round door knob The handle is turned to one side so a child can open the door by pulling on the cord in the handle.

In FIG. 3, invention 10 is shown locked on to door knob 34. Knob clamp half 12 and knob clamp 20 have been adjusted to fit door knob 34 by bolt 26 in washer cap nut 26. A child cord 44 is attached at the lower end of the assembled handle through a special aperture 40. Child cord 44 has a child cord end know 46 at the end to make it easier to hold on to. FIG. 4 show invention 10 in a side view attached to door knob 34. Door knob 34 is the opener for door 36 through door knob plate 38. FIG. 5 illustrates the best position for invention 10 when attached to door knob 34. Child cord 44 is hanging down vertically and is in easy reach of a child. Also, in the position shown in FIG. 5, the device of invention 10 is easy to be pushed down by an older person who might not have strength to turn knob 34 otherwise.

For use, invention 10 is attached to door knob 34 as illustrated in FIGS. 3, 4, and 5. A handle, (16, 30) can be grasp and pushed or pulled to open a door 36.

Although I have described a principal embodiment of my invention with considerable detail in the foregoing specification and have illustrated it extensively in the drawings, it is to be understood that I may practice variations in the invention which do not exceed the scope of the appended claims. Any variation of the present invention practiced by others that falls within the scope of the claims following, I shall consider to be my invention.

What is claimed is:

1. A two-piece handle attachment device for round door knobs, comprising:

a door knob clamp having a first semicircular clamp half and a second semicircular clamp half, each clamp half having two ends;

an elongated handle having a first handle half and a second handle half, one end of each handle half being affixed to one end of each clamp half, respectively;

adjusting means on said handle for affixing said clamp halves together to define a round opening for receiving a door knob, said means being adjustable to increase or decrease the size of said round opening;

means on said handle for affixing said handle halves together to define said elongated handle;

extension means attached adjacent to the other ends of said handle halves for providing an extension to said handle.

2. The device as set forth in claim 1 wherein said adjusting means includes a bolt being affixed through said handle halves by a nut.

3. The device as set forth in claim 1 wherein said means for affixing said handle halves includes a lock tab on the other end of the first handle half and a lock catch on the other end of the second handle half.

4. The device as set forth in claim 1 wherein said extension means includes a cord with a knobbed end affixed through both handle halves.

* * * * *